US010864554B2

(12) United States Patent
Liu et al.

(10) Patent No.: US 10,864,554 B2
(45) Date of Patent: Dec. 15, 2020

(54) MUNICIPAL WASTE SORTING SYSTEM

(71) Applicant: Chuhe Tian, Shenzhen (CN)

(72) Inventors: Xiaojun Liu, Shenzhen (CN); Caixia Wang, Shenzhen (CN); Junlong Liu, Shenzhen (CN)

(73) Assignee: Chuhe Tian, Shenzhen (CN)

( * ) Notice: Subject to any disclaimer, the term of this patent is extended or adjusted under 35 U.S.C. 154(b) by 119 days.

(21) Appl. No.: 16/147,603

(22) Filed: Sep. 29, 2018

(65) Prior Publication Data

US 2019/0240702 A1 Aug. 8, 2019

(30) Foreign Application Priority Data

Feb. 8, 2018 (CN) ..... 2018 1 0128767

(51) Int. Cl.

*B07C 5/342* (2006.01)
*B07C 5/38* (2006.01)
*B07C 5/36* (2006.01)

(52) U.S. Cl.

CPC ..... *B07C 5/3422* (2013.01); *B07C 5/36* (2013.01); *B07C 5/362* (2013.01); *B07C 5/38* (2013.01); *B07C 2501/0054* (2013.01)

(58) Field of Classification Search

CPC ..... B07C 5/3422; B07C 5/36; B07C 5/362; B07C 5/38; B07C 2501/0054

USPC ..... 209/577

See application file for complete search history.

(56) References Cited

U.S. PATENT DOCUMENTS 5,746,324 A * 5/1998 Smedlund ..... B03B 9/06 209/705

FOREIGN PATENT DOCUMENTS

CN 203316405 U * 12/2013

* cited by examiner

*Primary Examiner* — Terrell H Matthews

(57) ABSTRACT

The municipal waste sorting system includes a sorting guide rail frame and garbage collecting boxes arranged on two sides of the sorting guide rail frame, a first recycling bin disposed on a tail of the sorting guide rail frame and a second recycling bin in communication with the first recycling bin. A garbage discharge pipe is connected with an end head portion of a front end of the sorting guide rail frame and discharges the garbage into the sorting guide rail frame. A guide rail assembly is arranged on an upper portion of the sorting guide rail fame to transport garbage. A first sorting manipulator assembly, a second sorting manipulator assembly and a third sorting manipulator assembly are arranged on the sorting guide rail frame to screen the garbage to the garbage collecting boxes.

6 Claims, 3 Drawing Sheets

A

MUNICIPAL WASTE SORTING SYSTEM

BACKGROUND FIELD

The present disclosure relates to the technical field of municipal waste sorting systems, and more particularly to a municipal waste sorting system capable of having a high degree of automation, reasonable design, high reliability, high intelligence, and effectively improve working environment of workers.

DESCRIPTION OF PRIOR ART

"Harmless, reduce, and resourceful" of the treatment and utilization of municipal waste is a worldwide issue. At present, centralized treatment methods for urban and rural municipal waste in China mainly include landfills, composting, and incineration. The landfill method covers a large area, and the degree of waste reduction is low and further needs to be treated with an anti-seepage treatment. It is also necessary to build a biogas recovery and percolate treatment plant. The landfill method is easy to cause pollution to groundwater and surrounding air. The composting method is suitable for treating garbage containing more perishable organic matter. The composting method realizes comprehensive utilization of some resources, but the quality of compost is difficult to control, and harmful components are often exceeded. Electric power generation by waste incineration is developing very rapidly in China, but requires a large investment, has high operating costs and high operating risks, and there are difficulties in handling fly ash from dioxins and heavy metals. Moreover, although a very advanced and complex purification system is used, it is still very difficult to control or monitor the dioxin in the smoke. In order to fully embody "harmless, reduced, and resourced" principles, people present various integrated technologies for multipurpose municipal waste treatment. Although the current garbage comprehensive treatment technology contains a wide variety, the basic technical route is summarized as following steps: first sorting the garbage, and then the separated garbage materials are comprehensively processed in a classified manner. The municipal garbage in China is often collected in a mixing way. The original garbage, such as dried fruits, kitchen waste, has many high-water content perishable organic materials, which are stuck together with plastic bags, glass, metal and brick gravel. It is difficult for existing sorting machines to sort wet and sticky garbage. Only simple screening and manual sorting operations is able to be selected to treat the municipal garbage in the case of last resort. Disadvantages of the garbage disposal method are as follows: the working environment is poor for the workers, dust and odor cause great harm for the workers both physically and mentally, large number of sorting workers are required for sorting, cost is high, sorting efficiency is low, and quality of sorting is difficult to guarantee.

SUMMARY OF INVENTION

In order to overcome the problems existing in the prior art, the present disclosure provides a municipal waste sorting system capable of having high level automation, reasonable design, high reliability and high intelligence, and effectively improving working environment of the workers.

Compared with the prior art, the municipal waste sorting system comprises a sorting guide rail frame and garbage collecting boxes arranged on two sides of the sorting guide rail frame. A first recycling bin is disposed on a tail of the sorting guide rail frame and a second recycling bin is in communication with the first recycling bin. A garbage discharge pipe is connected with the end head portion of the front end of the sorting guide rail frame and the garbage discharge pipe is used to discharge garbage into the sorting guide rail frame. A guide rail assembly is arranged on an upper portion of the sorting guide rail frame and the guide rail assembly is used to transport garbage. A first sorting manipulator assembly, a second sorting manipulator assembly and a third sorting manipulator assembly are arranged on the sorting guide rail frame, and the first sorting manipulator assembly, the second sorting manipulator assembly and the third sorting manipulator assembly are used to separately screen the garbage to the garbage collecting boxes arranged on two sides of the sorting guide rail frame. A mobile guide rail arranged on the sorting guide rail frame is used to arrange the first sorting manipulator assembly, the second sorting manipulator assembly and the third sorting manipulator assembly. The sorting manipulator assemblies are used to separate garbage, and then the garbage is filtered by each of the recycling bins. The present disclosure is able to make a good garbage disposal. Structure of the present disclosure is reasonable in design and good in use, and the present disclosure has high intelligence.

DETAILED DESCRIPTION OF PREFERRED EMBODIMENTS

To make the objects, technical proposals and merits of the present disclosure more apparent, the present disclosure will be further described in detail with reference to the drawings and embodiments. It should be understood that the embodiments described here are only used to illustrate the present disclosure and are not intended to limit the present disclosure.

Figure 1:
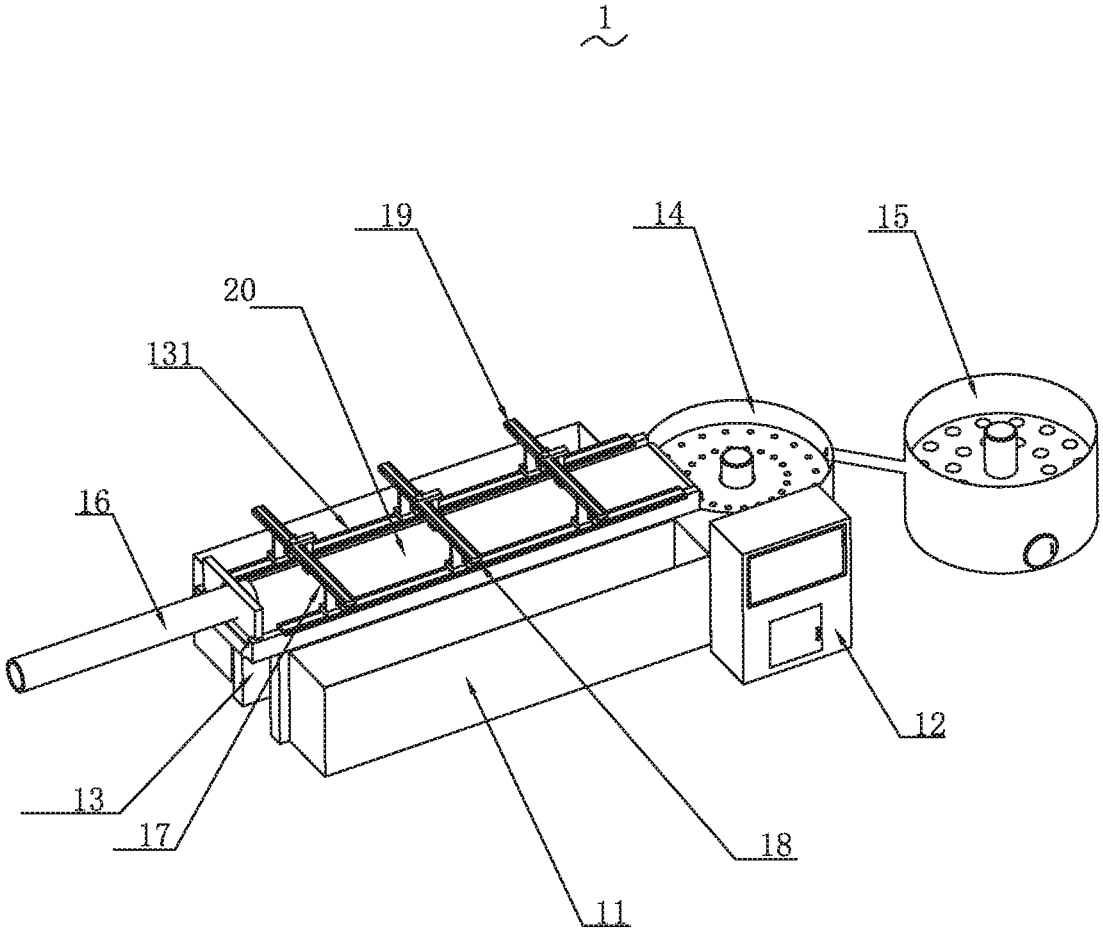
FIG. 1 is a perspective view showing a structure diagram of a municipal waste sorting system for effectively improving working environment of workers of the present disclosure.
Figure 2:
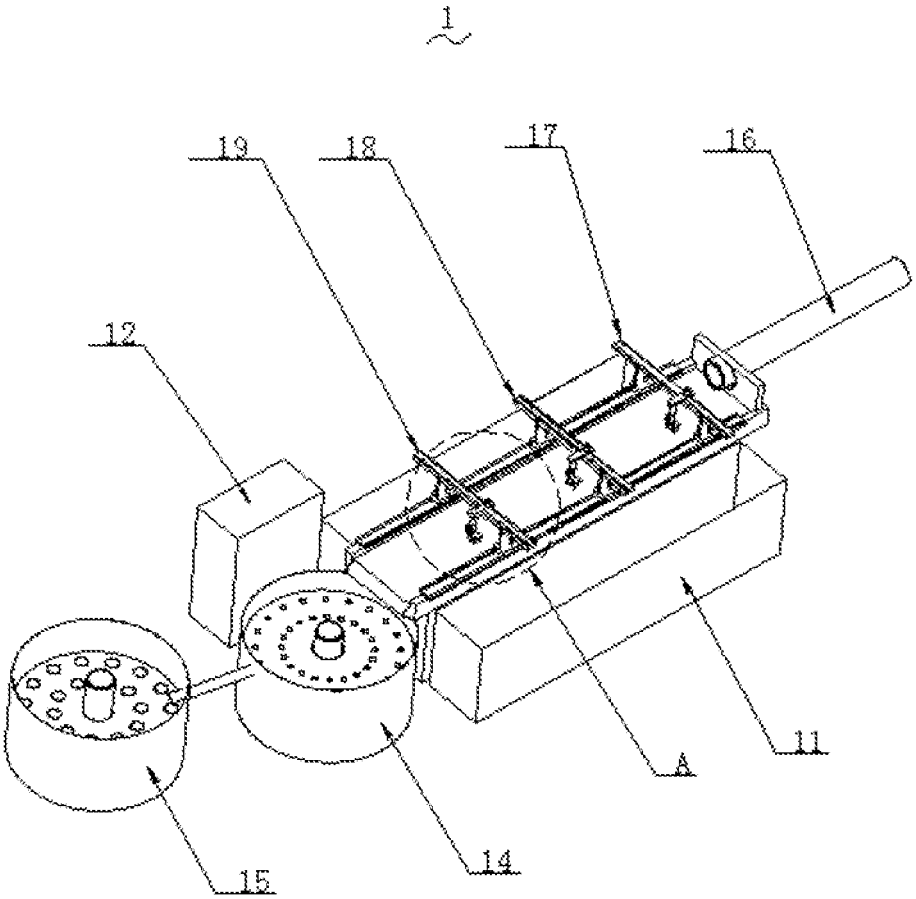
FIG. 2 is another perspective view showing a structure diagram of the municipal waste sorting system for effectively improving the working environment of the workers of the present disclosure.
Figure 3:
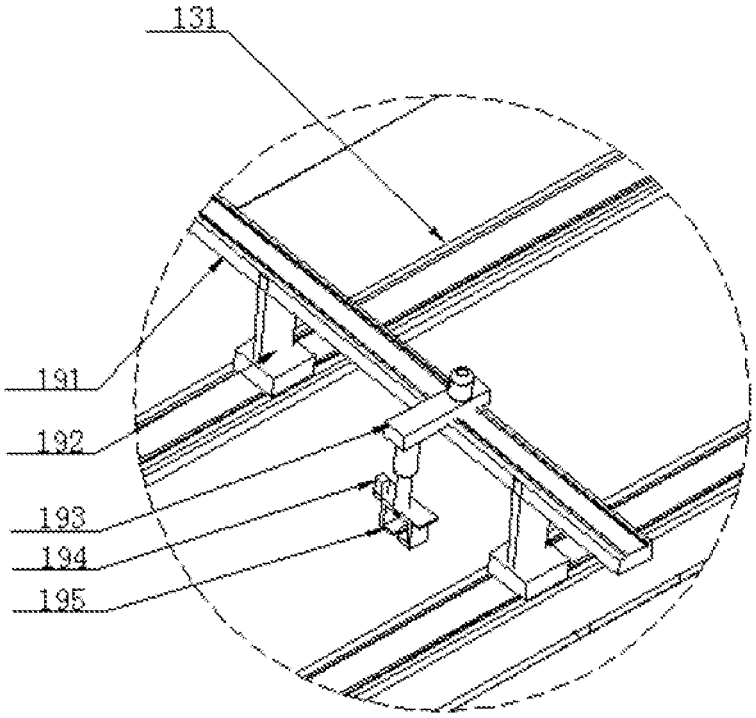
FIG. 3 is an enlarged view of a portion A in FIG. 2.

As shown in FIG. 1 to FIG. 3, the present disclosure provides a municipal waste sorting system 1 for effectively improving working environment of the workers comprises a sorting guide rail frame 13, garbage collecting boxes 11 arranged on two sides of the sorting guide rail frame 13, a first recycling bin 14 disposed on a tail of the sorting guide rail frame 13, and a second recycling bin 15 in communication with the first recycling bin 14. A garbage discharge pipe 16 is connected with an end head portion of a front end of the sorting guide rail frame 13 and the garbage discharge pipe 16 is used to discharge garbage into the sorting guide rail frame 13. A guide rail assembly 20 is arranged on an upper portion of the sorting guide rail frame 13 and the guide rail assembly 20 is used to transport garbage. In one embodiment, the guide rail assembly 20 can be a conveyor belt. A first sorting manipulator assembly 19, a second sorting manipulator assembly 18, and a third sorting manipulator assembly 17 are arranged on the sorting guide rail frame 13, and the first sorting manipulator assembly 19, the second sorting manipulator assembly 18 and the third sorting manipulator assembly 17 are used to separately screen garbage to the garbage collecting boxes 11 arranged on two sides of the sorting guide rail frame 13. A mobile guide rail 131 arranged on the sorting guide rail frame 13 is used to arranges the first sorting manipulator assembly 19, the second sorting manipulator assembly 18, and the third sorting manipulator assembly 17. Each sorting manipulator assembly is able to move freely on the mobile guide rail 131. The municipal waste sorting system 1 further comprises a control box 12 arranged near the first recycling bin 14. A power supply, a controller, a temperature sensor, a wireless communication transmission unit, a data memory, an alertor, and a BLUETOOTH unit are arranged inside the control box 12. A touch display screen and a plurality of control buttons are arranged on an external of the control box 12. An access door is arranged on a bottom of the control box 12. The temperature sensor, the wireless communication transmission unit, the data memory, the alertor, the BLUETOOTH unit, the touch display screen, and a plurality of the control buttons are electrically connected with the controller. The first sorting manipulator assembly 19 comprises two vertical support rods 192 arranged on the mobile guide rail 131, a transverse connecting rod 191 arranged on the two vertical supporting rods 192, a mechanical arm connecting block 193 parallel moving along the transverse connecting rod 191, and a mechanical arm 195 connected with the mechanical arm connecting block 193 to clamp the garbage. A high-definition camera assembly 194 electrically connected with the controller is arranged on the mechanical arm 195. A first driving motor is arranged on the mechanical arm connecting block 193 and is used to drive the mechanical arm connecting block 193 to move along the transverse connecting rod 191. A driving cylinder is arranged on the mechanical arm 195 and is used to drive the mechanical arm 195 to clamp garbage. The first driving motor, the driving cylinder, and the high-definition camera assembly 194 are electrically connected with the controller. The mechanical arm 195 of the first sorting manipulator arm assembly 19, a mechanical arm of the second sorting manipulator assembly, and a mechanical arm of the third sorting manipulator assembly are progressively decreased in size. A second driving motor is arranged on the sorting guide rail frame 13 and is used to drive the guide rail assembly 20, and the second driving motor is electrically connected with the controller. A first rotary shaft and a first filter plate mounted on the first rotary shaft are arranged inside the first recycling bin 14. A plurality of first filter holes are annular arranged on the first filter plate to filter garbage. A second rotary shaft and a second filter plate mounted on the second rotary shaft are arranged inside the second recycling bin 15. A plurality of second filter holes are annular arranged on the second filter plate to filter garbage. An aperture of the first filtering hole is less than an aperture of the second filter hole. A third driving motor is arranged in the first recycling bin 14 and is used to drive the first rotary shaft to rotate. A fourth driving motor is arranged in the second recycling bin 15 and is used to drive the second rotary shaft to rotate. The third driving motor and the fourth driving motor are electrically connected with the controller.

The municipal waste sorting system 1 of the present disclosure comprises the sorting guide rail frame 13 and garbage collecting boxes 11 arranged on two sides of the sorting guide rail frame 13. The first recycling bin 14 is disposed on the tail of the sorting guide rail frame 13 and the second recycling bin 15 is in communication with the first recycling bin 14. The garbage discharge pipe 16 is connected with the end head portion of the front end of the sorting guide rail frame 13 and the garbage discharge pipe 16 is used to discharge the garbage into the sorting guide rail frame 13. The guide rail assembly is arranged on the upper portion of the sorting guide rail frame 13 and the guide rail assembly is used to transport garbage. The first sorting manipulator assembly 19, the second sorting manipulator assembly 18, and the third sorting manipulator assembly 17 are arranged on the sorting guide rail frame 13, and the first sorting manipulator assembly 19, the second sorting manipulator assembly 18 and the third sorting manipulator assembly 17 are used to separately screen the garbage to the garbage collecting boxes 11 arranged on two sides of the sorting guide rail frame 13. The mobile guide rail 131 arranged on the sorting guide rail frame 13 is used to arrange the first sorting manipulator assembly 19, the second sorting manipulator assembly 18, and the third sorting manipulator assembly 17. The sorting manipulator assemblies are used to separate the garbage, and then the garbage is filtered by each of the recycling bins. The present disclosure is able to make a good garbage disposal. Structure of the present disclosure is reasonable in design and good in use, and the present disclosure has high intelligence.

Furthermore, a structure of the first sorting manipulator assembly 19, the second sorting manipulator assembly 18, and the third sorting manipulator assembly 17 are same.

Furthermore, an aperture of the first filter hole ranges from 2 cm to 5 cm.

Furthermore, an aperture of the second filter hole ranges from 4.5 cm to 7.5 cm.

Furthermore, the touch display screen is a capacitive touch display screen.

Furthermore, a discharge opening is arranged at a bottom portion of the second recycling bin 15.

Compared with the prior art, the municipal waste sorting system 1 comprises the sorting guide rail frame 13 and garbage collecting boxes 11 arranged on two sides of the sorting guide rail frame 13. The first recycling bin 14 is disposed on the tail of the sorting guide rail frame 13 and the second recycling bin 15 is in communication with the first recycling bin 14. The garbage discharge pipe 16 is connected with the end head portion of the front end of the sorting guide rail frame 13 and the garbage discharge pipe 16 is used to discharge the garbage into the sorting guide rail frame 13. The guide rail assembly is arranged on the upper portion of the sorting guide rail frame 13 and the guide rail assembly is used to transport garbage. The first sorting manipulator assembly 19, the second sorting manipulator assembly 18 and the third sorting manipulator assembly 17 are arranged on the sorting guide rail frame 13, and the first sorting manipulator assembly 19, the second sorting manipulator assembly 18 and the third sorting manipulator assembly 17 are used to separately screen the garbage to the garbage collecting boxes 11 arranged on two sides of the sorting guide rail frame 13. The mobile guide rail 131 arranged on the sorting guide rail frame 13 is used to arrange the first sorting manipulator assembly 19, the second sorting manipulator assembly 18 and the third sorting manipulator assembly 17. The sorting manipulator assemblies are used to separate the garbage, and then the garbage is filtered by each of the recycling bins. The present disclosure is able to make a good garbage disposal. Structure of the present disclosure is reasonable in design and good in use, and the present disclosure has high intelligence.

The above-described embodiments of the present disclosure are not to be construed as limiting the scope of the present disclosure. Any of the modifications, equivalent replacement, and improvement within the spirit and principle of the present disclosure should fall within the protection scope of the claims.

What is claimed is:

1. A municipal waste sorting system, comprising:

a sorting guide rail frame;

garbage collecting boxes arranged on two sides of the sorting guide rail frame;

a first recycling bin disposed on a tail of the sorting guide rail frame; and a second recycling bin in communication with the first recycling bin;

wherein a garbage discharge pipe is connected with an end head portion of a front end of the sorting guide rail frame and the garbage discharge pipe discharges garbage into the sorting guide rail frame;

wherein a guide rail assembly is arranged on an upper portion of the sorting guide rail frame and the guide rail assembly transports garbage;

wherein a first sorting manipulator assembly, a second sorting manipulator assembly, and a third sorting manipulator assembly are arranged on the sorting guide rail frame; the first sorting manipulator assembly, the second sorting manipulator assembly and the third sorting manipulator assembly separately screen the garbage to the garbage collecting boxes arranged on two sides of the sorting guide rail frame; a mobile guide rail arranged on the sorting guide rail frame arranges the first sorting manipulator assembly, the second sorting manipulator assembly, and the third sorting manipulator assembly; the first sorting manipulator assembly, the second sorting manipulator assembly, and the third sorting manipulator assembly are freely movable on the mobile guide rail;

wherein the municipal waste sorting system further comprises a control box arranged near the first recycling bin; a power supply, a controller, a temperature sensor, a wireless communication transmission unit, a data memory, and a BLUETOOTH unit are arranged inside the control box; and a touch display screen and a plurality of control buttons are arranged on an external of the control box; an access door is arranged at the bottom of the control box; and the temperature sensor, the wireless communication transmission unit, the data memory, the BLUETOOTH unit, the touch display screen and a plurality of control buttons are electrically connected with the controller;

wherein the first sorting manipulator assembly comprises two vertical support rods arranged on the mobile guide rail, a transverse connecting rod arranged on the two vertical supporting rods, a mechanical arm connecting block parallel moving along the transverse connecting rod, and a mechanical arm connected with the mechanical arm connecting block to clamp garbage; a high-definition camera assembly electrically connected with the controller is arranged on the mechanical arm; a first driving motor is arranged on the mechanical arm connecting block and drives the mechanical arm connecting block to move along the transverse connecting rod, a driving cylinder is arranged on the mechanical arm and drives the mechanical arm to clamp garbage; the first driving motor, the driving cylinder, and the high-definition camera assembly are electrically connected with the controller; the mechanical arm of the first sorting manipulator arm assembly, a mechanical arm of the second sorting manipulator assembly, and a mechanical arm of the third sorting manipulator assembly are progressively decreased in size; a second driving motor is arranged on the sorting guide rail frame and drives the guide rail assembly, the second driving motor is electrically connected with the controller; a first rotary shaft and a first filter plate mounted on the first rotary shaft are arranged inside the first recycling bin, a plurality of first filter holes are annular arranged on the first filter plate to filter garbage objects; a second rotary shaft and a second filter plate mounted on the second rotary shaft are arranged inside the second recycling bin, a plurality of second filter holes are annular arranged on the second filter plate to filter garbage; and an aperture of the first filtering hole is less than an aperture of the second filter hole; a third driving motor is arranged inside the first recycling bin and drives the first rotary shaft to rotate, a fourth driving motor arranged in the second recycling bin drives the second rotary shaft to rotate; the third driving motor and the fourth driving motor are electrically connected with the controller.

2. The municipal waste sorting system according to claim 1, wherein the first sorting manipulator assembly, the second sorting manipulator assembly, and the third sorting manipulator assembly have a same structure.

3. The municipal waste sorting system according to claim 1, wherein the aperture of the first filter hole ranges from 2 cm to 5 cm.

4. The municipal waste sorting system according to claim 1, wherein the aperture of the second filter hole ranges from 4.5 cm to 7.5 cm.

5. The municipal waste sorting system according to any claim 1, wherein the touch display screen is a capacitive touch display screen.

6. The municipal waste sorting system according to claim 1, wherein a discharge opening is arranged at a bottom portion of the second recycling bin.

* * * * *